United States Patent [19]

Uchikata et al.

[11] Patent Number: 4,955,738

[45] Date of Patent: Sep. 11, 1990

[54] PRINTER WITH DISENGAGEABLE RIBBON FEED

[75] Inventors: Yoshio Uchikata; Mineo Nozaki, both of Kawasaki; Osamu Asakura, Tokyo; Masasumi Nagashima, Yokosaka, all of Japan

[73] Assignee: Canon Kabushiki Kaisha, Tokyo, Japan

[21] Appl. No.: 203,503

[22] Filed: Jun. 6, 1988

Related U.S. Application Data

[63] Continuation of Ser. No. 880,111, Jun. 30, 1986, abandoned, which is a continuation of Ser. No. 630,187, Jul. 12, 1984, abandoned.

[30] Foreign Application Priority Data

Jul. 20, 1983 [JP] Japan ..... 58-130981
Jul. 20, 1983 [JP] Japan ..... 58-130983

[51] Int. Cl.[5] ..... B41J 33/04

[52] U.S. Cl. ..... 400/229; 400/120; 400/185

[58] Field of Search ..... 400/120, 185, 187, 229, 400/233

[56] References Cited

U.S. PATENT DOCUMENTS

| | | | |
|---|---|---|---|
| 3,855,448 | 12/1974 | Hanagata et al. | 400/120 |
| 4,030,587 | 6/1977 | Walker | 400/120 |
| 4,342,520 | 8/1982 | Isaha et al. | 400/233 |
| 4,350,987 | 9/1982 | Hanagata et al. | 400/120 |
| 4,420,268 | 12/1983 | Tsukamura et al. | 400/233 |
| 4,443,124 | 4/1984 | Ozawa | 400/185 |
| 4,444,521 | 4/1984 | Rickard et al. | 400/185 |
| 4,468,139 | 8/1984 | Hattori | 400/120 |
| 4,553,861 | 11/1985 | Lendl | 400/229 |
| 4,609,299 | 9/1986 | Hattori et al. | 400/229 |

FOREIGN PATENT DOCUMENTS

| | | | |
|---|---|---|---|
| 126203 | 11/1984 | European Pat. Off. | 400/229 |
| 160967 | 11/1985 | European Pat. Off. | 400/187 |
| 3403942 | 8/1985 | Fed. Rep. of Germany | 400/187 |
| 62184 | 5/1981 | Japan | 400/229 |
| 83484 | 5/1982 | Japan | 400/120 |
| 72475 | 4/1983 | Japan | 400/233 |
| 90978 | 5/1983 | Japan | 400/120 |
| 101075 | 6/1983 | Japan | 400/120 |
| 76286 | 5/1984 | Japan | 400/229 |
| 2079678 | 1/1982 | United Kingdom | 400/229 |

OTHER PUBLICATIONS

Bernard, "Ribbon Feed Mechanism", IBM technical Disclosure Bulletin, vol. 19, No. 2, p. 440, 7/76.

*Primary Examiner*—David A. Wiecking
*Attorney, Agent, or Firm*—Fitzpatrick, Cella, Harper & Scinto

[57] ABSTRACT

A printer has a platen for holding a recording paper sheet, a thermal head which is arranged to oppose the platen and which is urged against and prints on the paper sheet in response to a recording signal, a pivot lever for urging or separating the thermal head against or from the platen, a drive source for moving one of the thermal head and the paper sheet relative to the other, so that a new recording surface of the paper sheet sequentially opposes a front surface of the thermal head, a slide clutch for feeding an ink ribbon guided between the paper sheet and the thermal head, and an intermediate rotary body driven by a straight rail member, both of which are interposed between and couple the slide clutch and the drive source, thereby actuating the slide clutch when the thermal head is urged against the platen.

13 Claims, 3 Drawing Sheets

PRINTER WITH DISENGAGEABLE RIBBON FEED this application is a continuation of application Ser. No. 880,111 filed June 30, 1986, now abandoned, which is a continuation of application Ser. No. 630,187, filed July 12, 1984, now abandoned.

BACKGROUND OF THE INVENTION

1. Field of the Invention

The present invention relates to a printer which records or prints using an ink ribbon.

2. Description of the Prior Art

A full-line thermal head uses a full-line head which has heating elements along the entire recording width of a recording paper sheet. The head applies heat on an ink ribbon having the same width as itself, thereby performing thermal printing. During such a printing process, the ink ribbon and the recording paper sheet are fed at the same speed by separate drive sources so that they are fed at the same pitch.

However, it is difficult to feed the ink ribbon and the recording paper sheet in complete synchronism with each other. For example, during the initial stage of the feeding operation, one of the ink ribbon and the recording paper sheets cannot be immediately fed. Furthermore, in the stop operation, one of three ink ribbons and the recording paper sheet cannot be stopped. When these two members cannot be fed in synchronism with each other, this alone may not provide any adverse effect. However, if the two members are urged against each other by means of the thermal head, the paper sheet may be contaminated with the ink. Furthermore, if the recording paper sheet and the ink ribbon are fed by separate drive sources, the overall structure becomes complex.

In a serial thermal printer wherein a thermal head is urged against a recording paper sheet through an ink ribbon and a carriage is moved to perform printing, a ribbon cassette for feeding the ink ribbon is mounted on the carriage. The ink ribbon must be wound up at the same speed in synchronism with the movement of the thermal head, and hence, the movement of the carriage. For this purpose, a transmission shaft for transmitting the ribbon winding power is mounted on the carriage. However, in a conventional printer of this type, the up-down movement of the thermal head (swing movement between a printing position at which the head is urged against the paper sheet through the ink ribbon and a non-printing position at which the head is separate-d from the paper sheet) for paper feeding (or line feed) is controlled by a separate drive source from that for the winding operation of the ink ribbon. For this reason, the upward movement of the thermal head and the winding stop of the ink ribbon cannot be completely synchronized with each other. In addition, the downward movement of the thermal head and the feeding operation of the ink ribbon cannot be completely synchronized with each other either. Therefore, when the thermal head must be fed without printing with the thermal head in the up position, the ink ribbon is fed but is not used for printing, or the ink ribbon and the paper sheet may be urged against each other to contaminate the recording surface of the paper sheet.

When the thermal head is moved while the ink ribbon is stopped, the ink ribbon may be damaged, or the recording surface of the paper sheet may be contaminated since the head is urged against the recording paper sheet. Furthermore, separate drive sources (motor or the like) are required for up-down movement of the thermal head and the winding operation of the ink ribbon so that the overall printer becomes complex in structure and high in manufacturing cost.

SUMMARY OF THE INVENTION

It is an object of the present invention to provide a printer which can feed an ink ribbon only when a thermal head is at a down position (printing position).

It is another object of the present invention to feed an ink ribbon by means of a drive source which moves a thermal head relative to a recording paper sheet.

It is still another object of the present invention to prevent contamination of a recording paper sheet by being urged against an ink ribbon.

It is still another object of the present invention to simplify a carrying means.

It is still another object of the present invention to simplify the overall structure of the printer.

The above and other objects and features of the present invention will become apparent from the following description taken in conjunction with the accompanying drawings.

BRIEF DESCRIPTION OF THE DRAWINGS

FIGS. 1 to 3 show a first embodiment of the present invention, in which:

FIG. 1 is a plan view showing a main part (with a ribbon cassette removed) of a thermal transfer printer according to an embodiment of the present invention;

FIG. 2 is a plan view corresponding to FIG. 1, wherein the ribbon cassette (with a cover removed) is mounted, and FIG. 3 is a sectional view showing the printer (with the ribbon cassette mounted) shown in FIG. 1 along the line III—III therein; and FIGS. 4 to 6 show a second embodiment of the present invention, in which:

FIG. 4 is a plan view showing an up-down device of a thermal head at a down or printing position (in a state urged against a recording paper sheet) in a printer according to the present invention, FIG. 5 is a plan view showing the up-down device of the thermal head at an up or non-printing position (in a state separated from the recording paper sheet), and FIG. 6 is a sectional view of the device shown in FIG. 4 along the line VI—VI therein.

DETAILED DESCRIPTION OF THE PREFERRED EMBODIMENTS

The first embodiment of the present invention will be described with reference to FIGS. 1 to 3.

Figure 1:
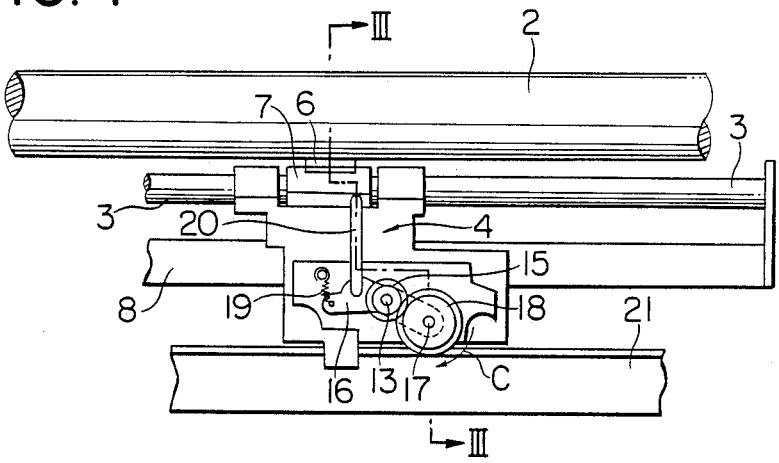
Figure 2:
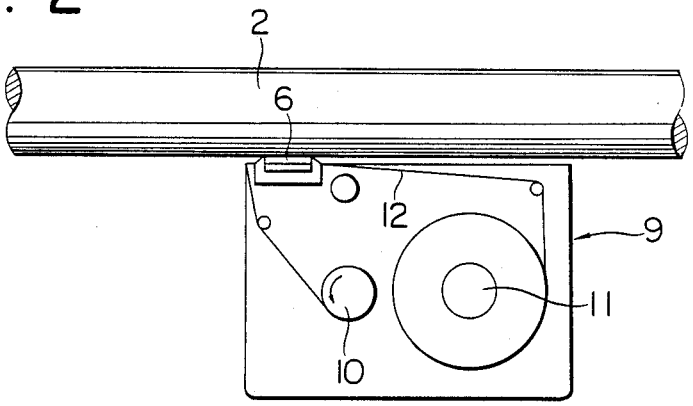
Figure 3:
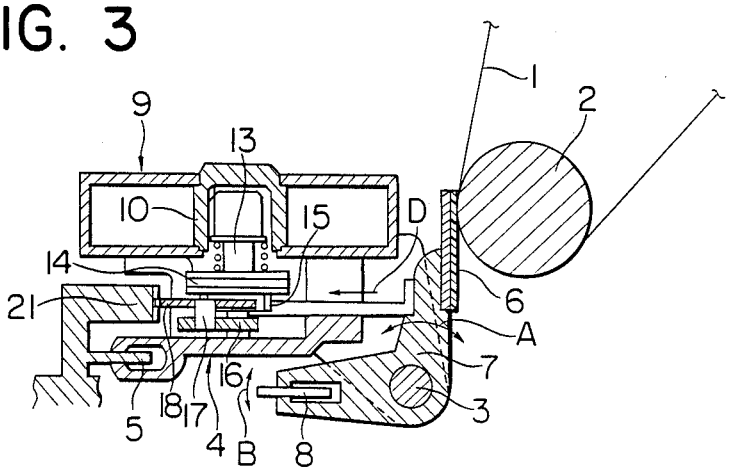

Referring to FIGS. 1 to 3, an elongated guide shaft 3 extends parallel to an elongated platen 2 supporting a recording paper sheet 1 from its rear surface. A carriage 4 extends along the guide shaft 3 so as to be parallel to the platen 2. The carriage 4 is supported by the guide shaft 3 and an elongated guide portion 5 which is formed on a printer main body (e.g., a frame) and parallel to the platen 2. The carriage 4 is moved by a drive source such as a motor (not shown) in only a direction parallel to the platen 2. A thermal head 6 capable of printing on the recording paper sheet 1 in accordance with a recording signal is mounted on a head holder 7. In this embodiment, the head holder 7 is fitted around the guide shaft 3 and is moved together with the carriage 4 parallel to the platen 2. The head holder 7 is supported on the carriage 4 movable or pivotal (along the direction indicated by arrow A in FIG. 3) between the up and down positions. The up-down pivotal movement of the head holder 7 is performed by driving a pivot lever 8 (FIG. 3) engaged at one end of the head holder 7 in a direction indicated by arrow B in FIG. 3. The pivot lever 8 extends parallel to the platen 2 and is supported integrally with the two ends of the guide shaft 3, so that the pivot lever 8 is pivotal about the axis of the guide shaft 3. In a normal state, the pivot lever 8 is biased upward by a spring (not shown) or the like to a position at which the pivot lever 8 urges the thermal head 6 against the recording paper sheet at a predetermined pressure. When the thermal head 6 is to be separated from the recording paper sheet for paper feeding or the like (head up), the pivot lever 8 is pivoted downward (FIG. 3) by a solenoid or the like against the biasing force of the spring.

A ribbon cassette 9 is mounted at a predetermined position on the upper surface of the carriage 4 by a suitable positioning pin (not shown). A take-up reel 10 and a supply reel 11 which are both rotatable are arranged inside the ribbon cassette 9. As shown in FIG. 2, an ink ribbon 12 is taken up from the supply reel 11 to the take-up reel 10 through the gap between the thermal head 6 and the recording paper sheet 1. The take-up reel 10 is taken up by a ribbon cassette drive shaft to be described later which is mounted on the carriage 4.

As shown in FIGS. 1 and 3, a transmission shaft 13 is rotatably fitted with the take-up reel 10 of the ribbon cassette 9 and is rotatably supported by the carriage 4. A slide clutch 14 comprising a pair of discs urged against each other through felt or the like at a predetermined pressure is mounted at a position midway along the transmission shaft 13. The slide clutch 14 has a mechanism for applying a frictional force so as to feed the ink ribbon at a predetermined peripheral speed by winding the ink ribbon 12 at a predetermined tension and slides when a tension exceeding the predetermined tension acts. A drive rotary body 15 comprising a gear or friction roller rotating together with the transmission shaft 13 is mounted on the transmission shaft 13. An arm-like swing member 16 is mounted on the transmission shaft 13 (near the lower end of the transmission shaft 13 in FIG. 3) so as to be pivotal about the axis of the transmission shaft 13.

A movable intermediate rotary body 18 comprising a gear or friction roller is rotatably mounted at one end of the swing member 16 and is engaged with the drive rotary body 15 for transmitting rotational force thereto. A tension spring 19 is hooked between the other end of the swing member 16 and the carriage 4, as shown in FIG. 1. In the normal state, the spring 19 biases the swing member 16 in the pivoting direction (clockwise) indicated by arrow C in FIG. 1.

A trigger lever 20 is mounted between the head holder 7 and the swing member 16 so as to transmit the pivot movement (up-down movement) of the thermal head 6 to the swing member 16. When the thermal head 6 is moved to the up position, the trigger lever 20 is moved in the direction indicated by arrow D. Then, the swing member 16 is pivoted in the direction (counterclockwise) opposite to the direction indicated by the arrow C in FIG. 1.

A straight rail 21 is arranged on the printer main body (e.g., the frame) so as to be parallel to the guide shaft 3 (i.e., parallel to the moving direction of the carriage 4). The straight rail 21 comprises a rack or a frictional surface so as to engage with the gear or the rotary roller of the intermediate rotary body 18 for transmitting the rotational force. When the thermal head 6 is at the printing position (head down or urging position) as shown in FIG. 1, the swing member 16 is biased in the direction indicated by the arrow C by the biasing force of the spring 19. Then, the intermediate rotary body 18 is urged against the straight rail 21, and the drive rotary body 15 is rotated through the intermediate rotary body 18 as the carriage 4 is moved. Then, the take-up reel 10 engaged with the transmission shaft 13 is driven to take up the ink ribbon 12. On the other hand, assume that the thermal head 6 is at the up position (non-printing position) at which the head is separated from the recording paper sheet 1. In this case, when the trigger lever 20 is moved in the direction indicated by the arrow D, the swing member 16 is pivoted in the direction (counterclockwise) opposite to that indicated by the arrow C against the biasing force of the spring 19. Then, the intermediate rotary body 18 is removed from the straight rail 21 to a free position so as to stop transmission of the force from a drive source for driving the carriage and to stop the rotation of the take-up reel 10.

According to the first embodiment described above, when the thermal head 6 is urged against or removed from (up-down movement) the recording paper sheet 1, a portion including the carriage 4 and the ribbon cassette 9 having a large mass is not pivoted, and only the thermal head 6 and the head holder 7 are pivoted. Therefore, the mass of the pivotal portion which is moved during the up-down movement of the head (printing and paper feed operations) can be reduced to the minimum, thereby reducing a load to be moved for such operations.

Since the ribbon cassette, which is less resistant to vibration, is not moved, problems such as loosening of the ribbon or disturbance to the wound state of the ribbon which are frequently caused in the conventional printer can be prevented. This leads to prevention of unclear printing or contamination of the paper with ink. Damage to the ink ribbon can also be prevented.

Since the carriage and the ribbon cassette are not pivoted, the space conventionally needed for pivoting these members is not required. Therefore, the overall printer can be rendered compact in size. Since the ON/-OFF operation of the intermediate rotary body 18 is performed in synchronism with the movement of the thermal head 6 (head holder 7), the power required to drive the ribbon cassette can be reduced to the minimum. Parts which have relatively large masses and which are expensive can be eliminated. The up-down movement of the thermal head 6 and the ON/OFF operation of the feeding operation of the ink ribbon can be synchronized with a simple structure. In this manner, wasteful consumption of the ink ribbon can be prevented.

In the above embodiment, the pivoting axis of the thermal head is the axis of the guide shaft 3 for guiding the carriage 4. However, the thermal head can pivot about another axis. For example, the head holder 7 can be pivotally supported on a separate pivot shaft mounted on the carriage 4.

Figure 4:
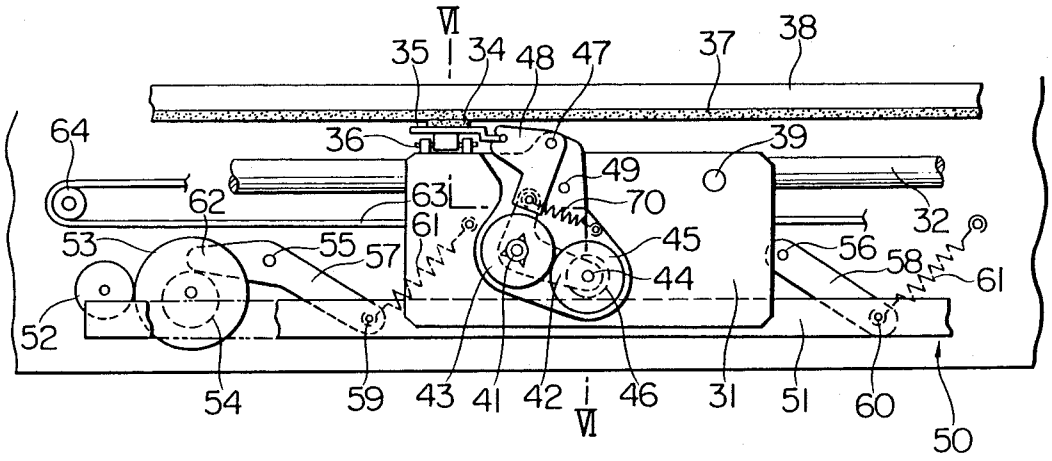
Figure 5:
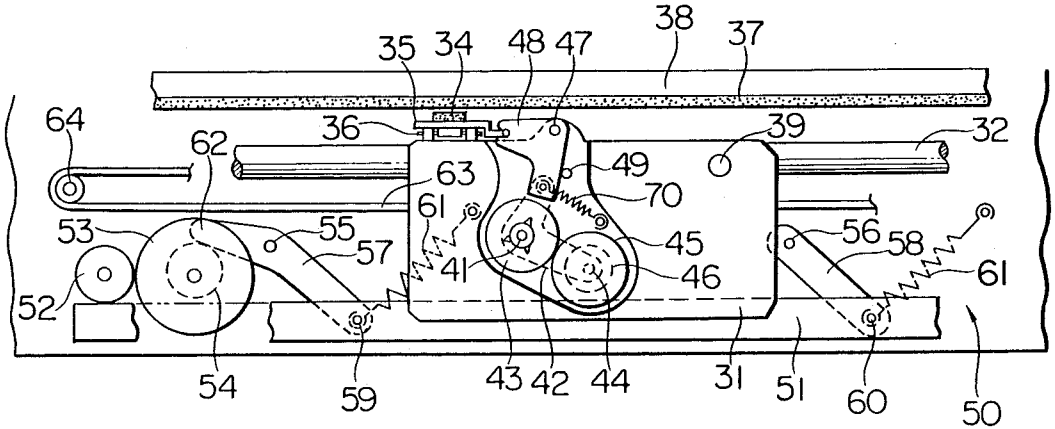
Figure 6:
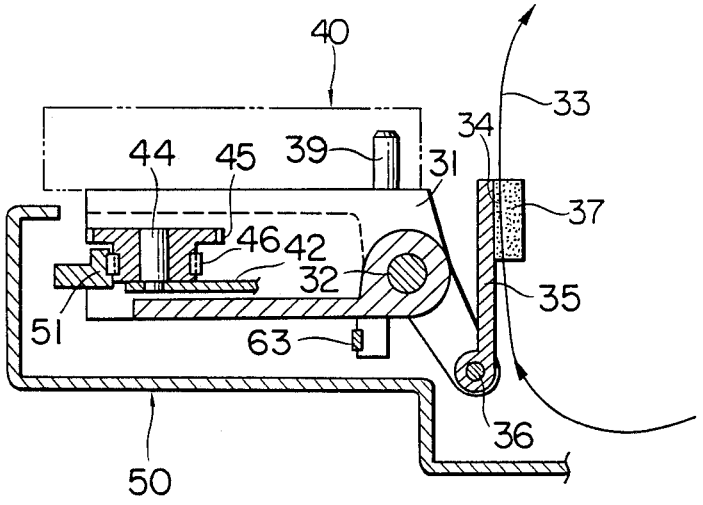

FIGS. 4 to 6 show a second embodiment of the present invention.

Referring to FIGS. 4 to 6, a carriage 31 is guided by a carriage shaft 32 parallel to a platen holder 38 and is moved along a recording paper sheet 33. The carriage 31 is moved by a motor (not shown) through a belt 63 mounted on a pulley 64 and coupled to the carriage 31. A head holder 35 having a thermal head 34 mounted thereon is pivotally or swingably mounted on a shaft 36 on the carriage 31. The recording paper sheet 33 (FIG. 6) is supported by a platen 37 which is arranged to cover substantially the entire carriage moving range. The platen 37 is held on the platen holder 38. A ribbon cassette 40 (in FIG. 6) is mounted at a predetermined position on the carriage 31 by a positioning pin 39 or the like. The ribbon cassette 40 has a supply reel and a take-up reel which are rotatable. The ribbon cassette has structure for feeding the ink ribbon on the supply reel at a predetermined speed through a gap between the thermal head 34 and the paper sheet 33 by driving the take-up reel.

A transmission shaft 41 on the carriage 31 engages with the ribbon cassette 40 (to be more specific the take-up reel of the ribbon cassette) and transmits The drive force for taking up the ink ribbon. A pivot lever 42 of bell crank-like shape is axially supported by the transmission shaft 41 to be pivotal about the axis thereof. A drive rotary body 43 is mounted on the transmission shaft 41 for rotation therewith. The drive rotary body 43 can comprise a gear or a rubber roller for transmitting power by friction and directly transmits power to the ink ribbon.

An intermediate shaft 44 is mounted at one end of the pivot lever 42. An intermediate rotary body 45 which is engaged or in contact with the drive rotary body 43 is axially supported on the intermediate shaft 44. In the embodiment shown in FIG. 4, a rotary drive portion 46 having a diameter different from the intermediate rotary body 45 is formed integrally therewith. Gear teeth or frictional transmission surfaces are formed on the circumferential surfaces of the intermediate rotary body 45 and the rotary drive portion 46. When the rotary body 45 and the drive portion 46 engage or contact with each other, the rotational force can be transmitted.

A head lever 48 pivotally mounted on a pivot shaft 47 on the carriage is coupled to the other end of the pivot lever 42. The head holder 35 is engaged with the other end of the head lever 48. Thus, when the head lever 48 is pivoted, the head holder 35 and hence the thermal head 34 can be moved up or down. A stopper 49 for defining the pivot range of the head lever 48 is mounted on the carriage 31. A spring normally biases the head lever 48 toward the stopper 49. The biasing force of the spring 70 serves to separate the thermal head 34 from the platen 37.

A printer main body or a frame 50 has a straight rail member 51 which is supported by a four-node link mechanism and which is movable to enable it to be urged against or separated from the rotary drive position 46. The straight rail member 51 comprises a rod- or strip-like member as shown in FIG. 4 and has a length covering the moving range of the carriage 31. As the carriage 31 moves, the straight rail member 51 drives the intermediate rotary body 45. When the rotary drive portion 46 comprises a gear, a rack is formed. When the rotary drive portion 46 comprises a frictional transmission surface such as a rubber roller, a similar member is incorporated.

The support structure (the above-mentioned four-node link mechanism) and the operating mechanism thereof for the straight rail member 51 will be described.

A motor gear 52 driven by a power source such as a pulse motor is axially supported on the frame 50. A cam gear 53 axially supported on the frame 50 meshes with the motor gear 52. An eccentric cam 54 is formed integrally with the cam gear 53.

Pins 55 and 56 are arranged at two positions on the frame 50 which are spaced apart by a predetermined distance. Link members 57 and 58 are pivotally supported on these pins 55 and 56. The distal ends of the link member 57 and 58 are connected through pins 59 and 60 to positions on the straight rail member 51 which are spaced apart by the same distance as between the pins 55 and 56. The link lengths of the link members 57 and 58, that is, the distance between the pins 55 and 59 and that between the pins 56 and 60 are selected to be the same, thereby constituting the four-node link mechanism having these four pins as the four nodes.

The link member 57 and 58 are biased counterclockwise by tension springs 61. An arm 62 formed at the extending portion of one link member (the link member 57 in the case shown in FIG. 4) is urged against the cam 54. The straight rail member 51 is arranged parallel to the moving direction of the carriage 31. The straight rail member 51 is vertically moved (as seen in FIGS. 4 and 5) by the four-node link mechanism while it is kept parallel to the moving direction of the carriage 31, as shown in FIGS. 4 and 5. Upon parallel movement thereof, the straight rail member 51 is moved between the urged position at which it is urged against the rotary drive portion 46 of the intermediate rotary body 45 and pivots the pivot lever 42 counterclockwise in FIGS. 4 and 5 and the nonactive position at which it is separated from the rotary drive portion 46 of the intermediate rotary body 45.

The printer having the construction described with reference to FIGS. 4 to 6 is operated as described below.

When printing is to be performed by urging the thermal head 34 against the recording paper sheet 33, that is, in the down operation, the eccentric cam 54 is driven by the motor gear 52 in the state shown in FIG. 4. In this state, the link members 57 and 58 are pivoted counterclockwise by the respective springs 61. The straight rail member 51 is urged against the rotary drive portion 46 of the intermediate body 45 by the biasing forces of these springs 61 and pivots the pivot lever 42 counterclockwise. Thus, the head lever 48, which is pivoted clockwise about the pivot shaft 47, places the thermal head 34 engaged therewith in the urged state (head down state). At the same time, since the rotary drive portion 46 is urged against the straight rail member 51, as the carriage 31 is moved, the intermediate rotary body 45 is driven. Then, the transmission shaft 41 is also driven, and the ink ribbon is taken up.

Since the straight rail member 51 alone is driven in this manner, the urging operation of the thermal head and the winding up of the ink ribbon can be performed in synchronism with each other.

When the thermal head 34 is moved to the up position, the eccentric cam 54 is driven to the state shown in FIG. 5, i.e., to a position rotated through 180° from the state shown in FIG. 4. In this state, the link member 57 is pivoted clockwise about the pin 55. At the same time, the other link member 58 is pivoted by the same angle while maintaining the parallel relationship with the link member 57. In this manner, the straight rail member 51 is driven downward (as seen in FIGS. 4 and 5), i.e., in the direction to be separated from the rotary drive portion 46.

As the straight rail member 51 is moved away from the rotary drive portion 46, the pivot lever 42 is about to be pivoted clockwise. However, the head lever 48 is pivoted counterclockwise about the pivot shaft 47 to move the head to the up position, and is thereafter brought into contact with the stopper 49 to have its rotating position regulated thereby. Therefore, the clockwise movement of the pivot lever 42 is regulated, the straight rail member 51 is separated from the rotary drive portion 46, and the intermediate rotary body 45 is set free. Then, the drive operation of the transmission shaft 41 and the winding operation of the ribbon cassette are both stopped.

In this manner, the winding operation of the ribbon cassette can be stopped in complete synchronism with the head up operation of the thermal head 34.

In the embodiment described above, the urging and separating operations of the thermal head 34 and the stopping of the winding operation of the ink ribbon can be performed in complete synchronism with each other. Accordingly, the ink ribbon can be fed reliably in accordance with the printing operation. In the head up operation, the feeding of the ink ribbon can be reliably stopped.

With the above embodiment, wasteful feeding of the ink ribbon when the non-printing drive of the thermal head (when the thermal head is moved while it is kept in the up position) can be completely and reliably prevented. In this manner, the ink ribbon is not wasted. Furthermore, in a similar manner, urging of the thermal head against the recording paper sheet will be prevented while the feeding operation of the ink ribbon is stopped. Therefore, damage to the ink ribbon and contamination of the recording paper sheet can both be prevented.

The straight rail member 51 for performing up-down operation of the thermal head 34 is supported by the four-node link mechanism at two points which are separated by a predetermined distance. Therefore, the strength and rigidity of the straight rail member can be improved, and the dimensions and weight of this member can therefore be reduced to obtain the same strength. The load required to perform the up-down movement of the thermal head can thus be reduced.

The drive rotary body 43, the intermediate rotary body 45, and the rotary drive portion 46 may comprise gears, and a rack may be formed on the contact surface of the straight rail member 51. However, the gears and the track can comprise smooth surfaces capable of frictional transmission.

The present invention is not limited to a serial printer in which a printing head is moved by a carriage but can be applied to a full-multi printer.

The ink ribbon need not be housed inside a cassette, but the spools can be exposed to the outside.

The ink ribbon need not be mounted on the carriage but may be held at the side of the printer main body.

What we claim is:

1. A printer for effecting image recording on a recording medium by using an ink ribbon moved by a winding portion, the printer comprising:

a platen;

a carriage movable along a conveyance route of the recording medium and having a mounting portion for mounting the ink ribbon thereon;

a mounting portion, coupled to said carriage, for mounting the ink ribbon;

a thermal head on said carriage, said thermal head being movable relative to said carriage and relative to said mounting portion between a record position for effecting image recording on the recording medium and a withdrawn position displaced from the record position;

an engaging member disposed along the path of said carriage;

a rotary member for engaging said engaging member to obtain a drive force for moving the ink ribbon as said carriage moves along said platen;

transmission means for transmitting the drive force to the winding portion to move the ink ribbon; and displacing means for moving said engaging member between an engaging position, wherein said engaging member engages said rotary member, and a withdrawn position, wherein said engaging member is withdrawn from the engaging position.

2. The printer of claim 1, wherein said displacing means move said engaging member parallel to said platen.

3. A printer for recording onto a recording medium, comprising:

an ink ribbon mounting section on which an ink ribbon is mountable;

a carriage reciprocally movable along a conveyance route of the recording medium;

a recording head provided on said carriage and movable independently from said carriage between a recording position for recording onto the recording medium and a retracted position retracted from said recording position;

transmitting means for transmitting to an ink ribbon winding section a driving force effected by movement of said carriage so as to wind the ink ribbon mounted on said ink ribbon mounting section, said transmitting means being capable of assuming a connecting state where said driving force is transmittable to said ink ribbon winding section and a non-connecting state where said driving force is not transmittable to said ink ribbon winding section; and means for shifting said transmitting means to said connecting state when said recording head is shifted to said recording position and for shifting said transmitted means to said non-connecting state when said recording head is shifted to said retracted position.

4. A printer according to claim 3, wherein said synchronizing means includes a link member for moving said transmission means in response to movement of said thermal head relative to said carriage.

5. A printer according to claim 3, wherein said transmission means includes a rail member extending parallel to the recording medium and a rotary member movably mounted on said carriage for rotation when in contact with said rail member as said carriage moves across the recording medium.

6. A printer according to claim 5, further comprising common biasing means biasing said thermal head to the record position and said rotary member into contact with said rial member.

7. A printer for effecting image recording on a recording medium by using an ink ribbon moved by a winding portion, the printer comprising:

a platen;

a carriage movable long a conveyance route of the recording medium and having a mounting portion for mounting the ink ribbon thereon;

a mounting portion, coupled to said carriage, for mounting the ink ribbon;

a thermal head on said carriage, said thermal head being movable relative to said carriage and relative to said mounting portion between a record position for effecting image recording on the recording medium and a non-record position displaced from the record position;

an engaging member disposed along the path of said carriage;

a rotary member movable between an engaging position, wherein said rotary member engages said engaging member to provide a drive force as said carriage moves along said platen, and a withdrawn position, wherein said rotary member is withdrawn from said engaging position;

transmission means for transmitting the drive force to the winding portion to move the ink ribbon; and synchronizing means for causing said rotary member to occupy the engaging position in synchronism with movement of said thermal head to the record position and to occupy the withdrawn position in synchronism with movement of said thermal head to the non-record position.

8. A printer according to claim 7, wherein said transmission means has a drive rotary member which is normally in contact with said rotary member and which has a fixed axis, and said drive rotary member move the ink ribbon.

9. A printer according to claim 7, wherein said synchronizing means elastically urges said thermal head against said platen and elastically urges said rotary member against said engaging member.

10. A printer according to claim 7, further comprising common biasing means biasing said thermal head to the record position and said rotary member to the engaging position.

11. A printer according to claim 7, wherein said carriage is movably guided by a plurality of elongated guide members, and said thermal head is guided by one of said guide members so as to be rotatable between the record and non-record positions.

12. A printer according to claim 11, further comprising a pivot lever arranged parallel to said platen to movably guide said thermal head away from said platen to the non-record position.

13. A printer according to claim 11, wherein said engaging member comprises a rail member disposed parallel to said platen and said rail member and one of said guide members are formed integrally with each other.

* * * * *

UNITED STATES PATENT AND TRADEMARK OFFICE

CERTIFICATE OF CORRECTION

PATENT NO. : 4,955,738

DATED : September 11, 1990

INVENTOR(S) : UCHIKATA ET AL.

It is certified that error appears in the above-identified patent and that said Letters Patent is hereby corrected as shown below: ON TITLE PAGE:

AT [56] REFERENCES CITED

U.S. Patent Document, "Isaha et al." should read --Isobe et al.--.
Other Publications, "technical" should read --Technical--.

COLUMN 1

Line 5, "this" should read --This--.
Line 52, "rate-d" should read --rated--.

COLUMN 5

Line 19, "The" should read --the--.
Line 48, "spring" should read --spring 70--.

COLUMN 6

Line 10, "link member 57 and 58" should read --link members 57 and 58--.
Line 18, "link member 57 and 58" should read --link members 57 and 58--.

UNITED STATES PATENT AND TRADEMARK OFFICE

CERTIFICATE OF CORRECTION

PATENT NO. : 4,955,738

DATED : September 11, 1990

INVENTOR(S) : UCHIKATA ET AL. Page 2 of 2

It is certified that error appears in the above-identified patent and that said Letters Patent is hereby corrected as shown below:

COLUMN 8

Lines 1 and 2 should be deleted.
Line 22, "move" should read --moves--.
Line 48, "transmitted means" should read --transmitting means--.
Line 51, "syn-" should be deleted.
Line 52, "chronizing means" should read --means for shifting--.
Line 64, "rial member" should read --rail member--.

COLUMN 9

Line 1, "long" should read --along--.
Lines 4 and 5 should be deleted.

COLUMN 10

Line 4, "move" should read --moves--.

Signed and Sealed this

Twenty-fifth Day of February, 1992

*Attest:*

HARRY F. MANBECK, JR.

*Attesting Officer*

*Commissioner of Patents and Trademarks*